US012799686B2

(12) United States Patent
Berrouard

(10) Patent No.: US 12,799,686 B2
(45) Date of Patent: Nov. 17, 2026

(54) TAMPER AND METHOD OF FABRICATION THEREOF

(71) Applicant: GARANT GP, Saint-François-de-la-Rivière-du-Sud (CA)

(72) Inventor: Mathieu Berrouard, Lévis (CA)

(73) Assignee: GARANT GP

( * ) Notice: Subject to any disclaimer, the term of this patent is extended or adjusted under 35 U.S.C. 154(b) by 412 days.

(21) Appl. No.: 18/417,587

(22) Filed: Jan. 19, 2024

(65) Prior Publication Data

US 2024/0247449 A1 Jul. 25, 2024

Related U.S. Application Data

(60) Provisional application No. 63/481,294, filed on Jan. 24, 2023.

(51) Int. Cl.
*E01C 19/32* (2006.01)

(52) U.S. Cl.
CPC ..... *E01C 19/32* (2013.01)

(58) Field of Classification Search
CPC ..... E01C 19/32; B25G 1/102
USPC ..... 404/133.1; 37/265, 278, 284, 285, 379; 172/348, 361, 362, 368, 374; 16/411; D8/107
See application file for complete search history.

(56) References Cited

U.S. PATENT DOCUMENTS

D262,185 S * 12/1981 Huber ..... D8/62
4,958,407 A * 9/1990 Johnson ..... A01B 1/22 294/58
D341,305 S * 11/1993 Svetlik ..... D8/70
D349,637 S * 8/1994 Hoshino ..... D8/67
D450,230 S * 11/2001 Long ..... D8/67
D489,592 S * 5/2004 Hessenberger ..... D8/67
6,742,222 B2 * 6/2004 Furr-Britt ..... A47L 9/325 16/438
6,820,628 B2 * 11/2004 Larson ..... A01B 1/02 294/1.4
D501,633 S * 2/2005 Kruepke ..... E04F 21/248 D8/107
9,803,388 B2 * 10/2017 Cunningham ..... E04H 17/263
D877,580 S * 3/2020 Dishman ..... D8/14
D969,579 S * 11/2022 Dishman ..... D8/14
D1,020,414 S * 4/2024 Thorn ..... D8/10
D1,035,413 S * 7/2024 Berrouard ..... D8/107
(Continued)

OTHER PUBLICATIONS

Ames®—True Temper™ Tamper—TOOLSiD—Dec. 9, 2022.
(Continued)

*Primary Examiner* — Gary S Hartmann

(74) *Attorney, Agent, or Firm* — Gwendoline Bruneau; Lavery, de Billy, L.L.P.

(57) ABSTRACT

A tool, such as an impact tool, and a method of fabrication of the tool, are presented. The tool comprises at least a first and a second grip members extending generally parallel to the shaft on each side of the shaft and configured such that each one of the first and the second grip members is grasped by a user with a respective hand of the user, thereby centering the user above a ground surface to be worked with the tool, with the user's legs spreading about shoulder width, the user's head centered between the user's feet, and both the user's hands level on a line generally perpendicular to the shaft.

18 Claims, 8 Drawing Sheets

(56) References Cited

U.S. PATENT DOCUMENTS

2010/0175225 A1* 7/2010 Sanchez Santos ..... A01B 1/00 16/426
2012/0111593 A1* 5/2012 O'Toole ..... E04H 17/26 173/171

OTHER PUBLICATIONS

Ames® 30005—RazorBack™ 10_×10_ Stee . . . er with 42_ Steel Handle—TOOLSiD—Dec. 9, 2022.
Ames® 1133400—True Temper™ 8_×8_ St . . . with 42_ Hardwood Handle—TOOLSiD—Dec. 9, 2022.
Ames® 1133700—True Temper™ 10_×10_ . . . with 42_ Hardwood Handle—TOOLSiD—Dec. 9, 2022.
Ames® 2233400—8_×8_ Steel Tamper with 42_ Hardwood Handle—TOOLSiD—Dec. 9, 2022.
Bon®—Dirt Tamper—TOOLSiD—Dec. 9, 2022.
Bon®—Hand Concrete Tamper—TOOLSiD—Dec. 9, 2022.
Bon®—Soil Probe—TOOLSiD—Dec. 9, 2022.
Bon®—Tamper—TOOLSiD—Dec. 9, 2022.
Bon®—Welded Dirt Tamper—TOOLSiD—Dec. 9, 2022.
Bon® 12-123—36_×5_ Rollerbug Rolling Tamper—TOOLSiD—Dec. 9, 2022.
Bon® 12-356—8_×8_ Cast Iron Dirt Tamper with 4_ Wood Handle—TOOLSiD—Dec. 9, 2022.
Bon® 12-357—10_×10_ Cast Iron Dirt Tamper with 4_ Wood Handle—TOOLSiD—Dec. 9, 2022.
Bon® 19-119—8_×8_ Aluminum Dirt Tamper with 4_ Steel Handle—TOOLSiD—Dec. 9, 2022.
Bon® 19-152—8_×8_ Steel Welded Dirt . . . per with 4_ Steel Handle—TOOLSiD—Dec. 9, 2022.
Bon® 19-153—10_×10_ Steel Welded Di . . . per with 4_ Steel Handle—TOOLSiD—Dec. 9, 2022.
Bon® 22-801—8_×8_ Steel Dirt Tamper with 4_ Steel Handle—TOOLSiD—Dec. 9, 2022.
Bon® 22-802—10_×10_ Steel Dirt Tamp . . . h 4_ Bolted Steel Handle—TOOLSiD—Dec. 9, 2022.
Bon® 22-827—8_×8_ Steel Dirt Tamper with 4_ Fiberglass Handle—TOOLSiD—Dec. 9, 2022.
Bon® 22-828—10_×10_ Steel Dirt Tamp . . . ith 4_ Fiberglass Handle—TOOLSiD—Dec. 9, 2022.
Bon® 22-829—11_×11_ Urethane Dirt T . . . ith 4_ Fiberglass Handle—TOOLSiD—Dec. 9, 2022.
Bon® 22-977—18_×5_ Diameter Rollerbug Rolling Tamper—TOOLSiD—Dec. 9, 2022.
Bon® 28-130—36_ Soil Probe—TOOLSiD—Dec. 9, 2022.
Bon® 28-131—48_ Soil Probe—TOOLSiD—Dec. 9, 2022.
Bon® 32-243—11_×11_ Urethane Dirt Tamper with 4_ Wood Handle—TOOLSiD—Dec. 9, 2022.
Bon® 82-144—12_×7-1_2_ Hand Concrete Tamper with 13_ Handle—TOOLSiD—Dec. 9, 2022.
Bon® 82-146—24_×7-1_2_ Hand Concret . . . mper with 30_ _T_Handle—TOOLSiD—Dec. 9, 2022.
Bon® 82-504—34_×7-1_2_ Big Diamond . . . mper with 31-1_2_ Handle—TOOLSiD—Dec. 9, 2022.
Bon® 82-791—36_×6-1_2_ Round Hole H . . . mper with 31-1_2_ Handle—TOOLSiD—Dec. 9, 2022.
Bon® 84-203—24_×18_ Steel Lawn and Sand Roller—TOOLSiD—Dec. 9, 2022.
Bon® 84-964—43_ Buster Bar—TOOLSiD—Dec. 9, 2022.
Compaction Tools _ Dirt & Hand Concrete Tampers, Soil Probes—TOOLSiD—Dec. 9, 2022.
Compaction Tools _ Dirt & Hand Concrete . . . rs, Soil Probes—TOOLSiD (2)—Dec. 9, 2022.

* cited by examiner

TAMPER AND METHOD OF FABRICATION THEREOF

CROSS-REFERENCE TO RELATED APPLICATIONS

This application claims benefit of U.S. provisional application Ser. No. 63/481,294, filed on Jan. 24, 2023. All documents above are incorporated herein in their entirety by reference.

BACKGROUND OF THE INVENTION

The present invention relates to tampers. More precisely, the present invention is concerned with a tamper and a method of fabrication thereof.

Tampers or compactors are used for leveling dirt and mulch after planting shrubs and small trees, leveling and packing paver head before installing a paver walkway, or for packing and leveling dirt, sand, and rock, for example.

A tamper typically comprises a square heavy tamper head at a distal end of a shovel-like handle. It must be used with care so as not to strike a leg or a foot, for example with the heavy head, usually in steel and prevent injuries.

There is still a need in the art for a tamper and a method of fabrication thereof.

SUMMARY OF THE INVENTION

More specifically, in accordance with the present invention, there is provided a tool comprising a shaft, a handle at a proximal end of the shaft, and a working head at a distal end of the shaft, wherein the handle comprises at least a first and a second grip members extending generally parallel to the shaft on each side of the shaft and configured such that each one of the first and the second grip members is grasped by a user with a respective hand of the user, thereby centering the user above a ground surface to be worked with the tool, with the user's legs spreading about shoulder width, the user's head centered between the user's feet, both the user's hands level on a line generally perpendicular to the shaft, and allowing the user to precisely control the working head.

There is further provided an impact tool comprising a shaft, a handle at a proximal end of the shaft, and a working head at a distal end of the shaft, wherein the handle comprises grip members extending generally parallel to the shaft on each side of the shaft; and the working head comprises an impacting surface, the grip members being configured such that each one of the first and the second grip members is grasped by a user with a respective hand of the user so that the user is centered above a ground surface to be impacted with the impact tool, with the user's legs spreading to about shoulder width, the user's head centered between the user's feet, both hands level on a line generally perpendicular to the shaft.

There is further provided a method for making a tool comprising a shaft, a handle, and a working head, comprising providing the handle with at least a first and a second grip members, connecting the handle with the proximal end of the shaft and the working head at a distal end of the shaft, the first and the second grip members extend generally parallel to the shaft on each side of the shaft; whereby the first and the second grip members are symmetrically positioned on each side of the shaft from grasping by a user using both hangs, one hand on a respective one of the first and the second grip members, centering the user above a ground surface to be worked with the tool, with the user's legs spreading about shoulder width, the user's head centered between the user's feet, both the user's hands level on a line generally perpendicular to the shaft.

Other objects, advantages and features of the present invention will become more apparent upon reading of the following non-restrictive description of specific embodiments thereof, given by way of example only with reference to the accompanying drawings.

DETAILED DESCRIPTION OF THE INVENTION

The present invention is illustrated by the following non-limiting examples.

Figure 1:
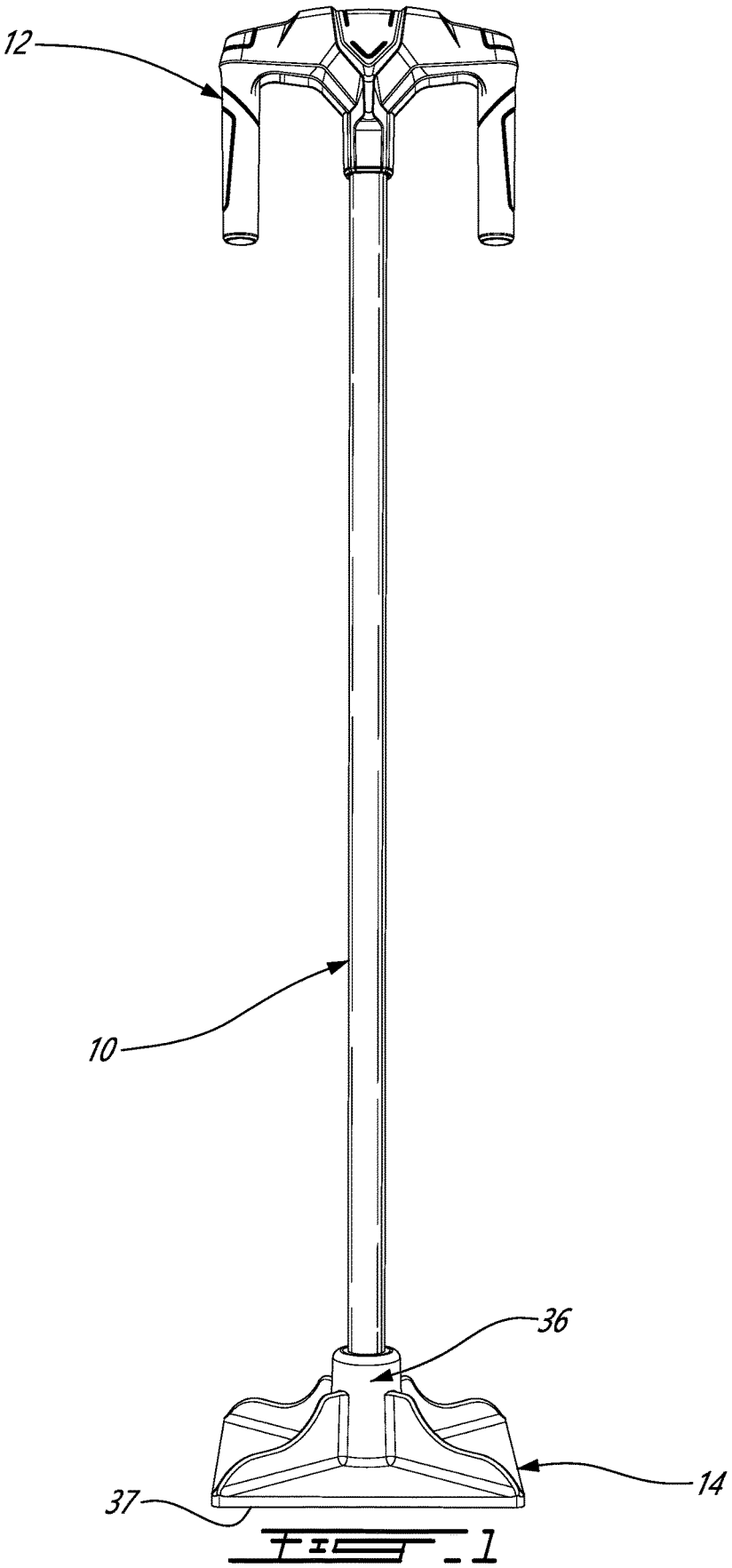
FIG. 1 is a front view of a tamper according to an embodiment of an aspect of the disclosure.
Figure 7A:
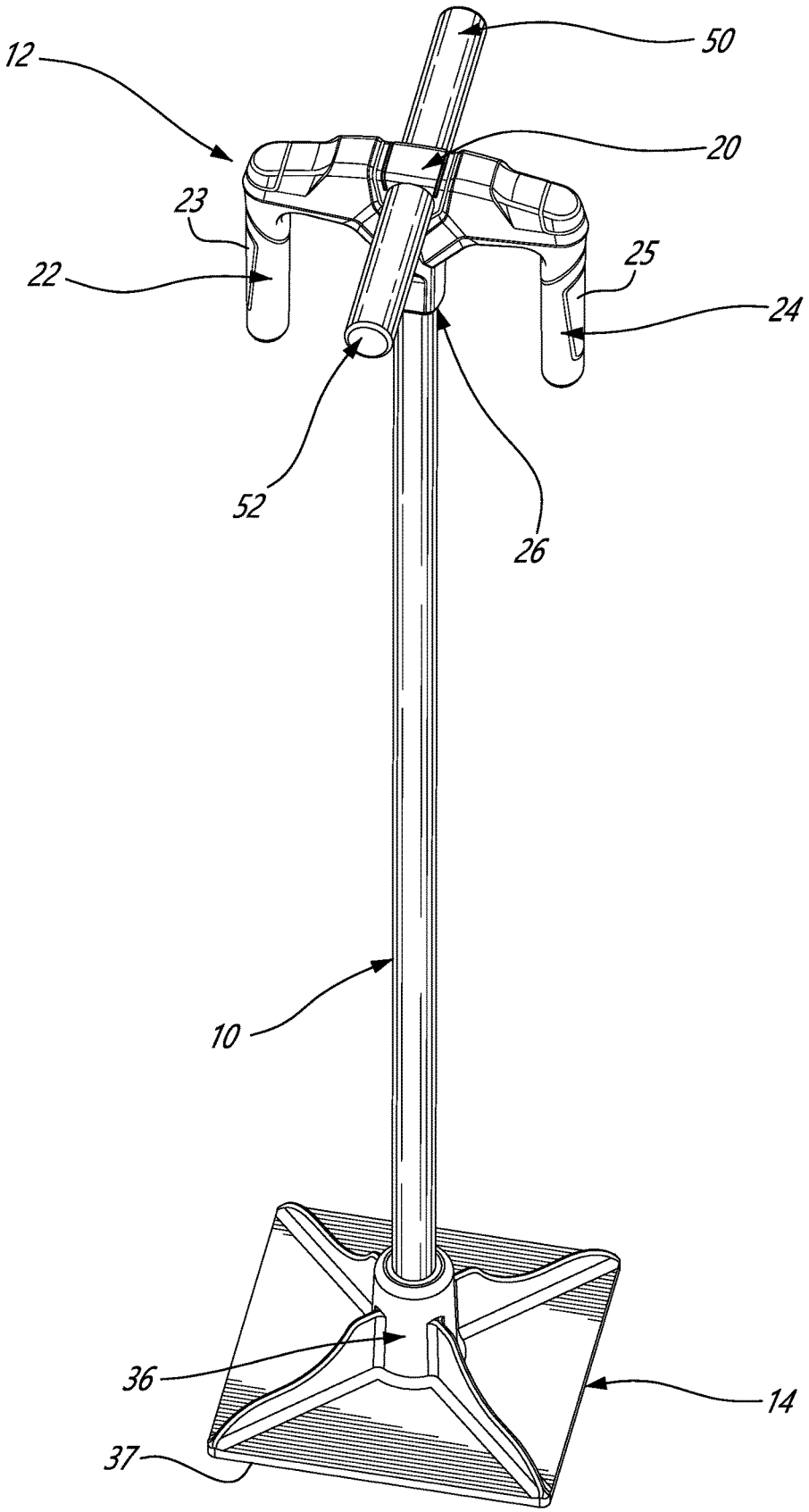
FIG. 7A is a perspective top view of a tamper according to an embodiment of an aspect of the disclosure.
Figure 7B:
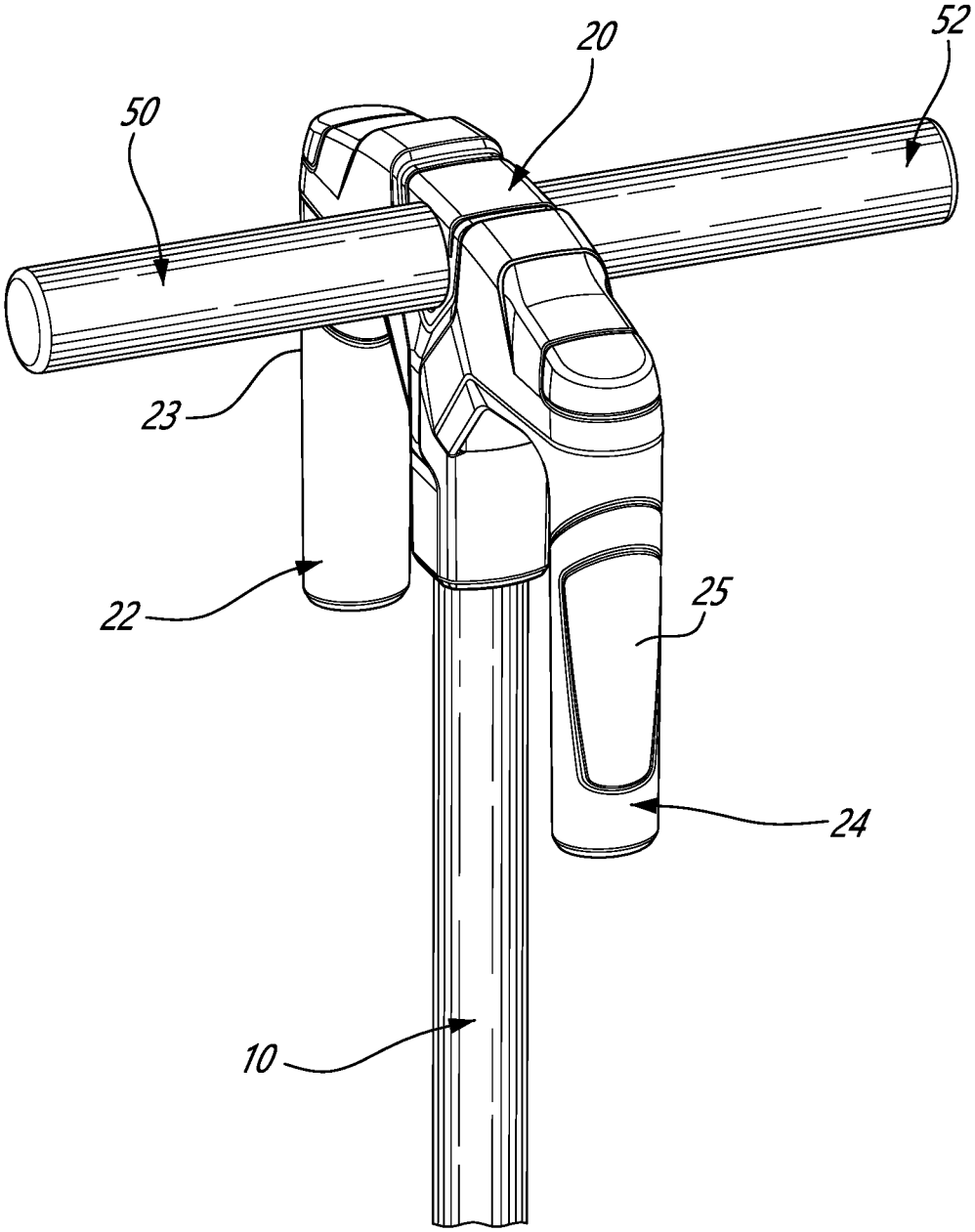
FIG. 7B shows the handle of the tamper of FIG. 7A according to an embodiment of an aspect of the disclosure.

A tamper, as illustrated for example in FIGS. 1 and 7A, comprises a shaft 10, a handle 12 at a proximal end of the shaft 10, and a tamper head 14 at a distal end of the shaft 10.

The shaft 10 is a straight member, of a circular, oval, square, or rectangular cross section for example, in wood, metal, plastic, composite for example. It may be hollow shaft, in metal, glass fibers, plastic, composite, for example. It may be in wood or steel, for example.

The tamper head 14 is made in a heavy, shock resistant material, such as steel, rubber, aluminum for example, with a square or rectangular flat lower surface 37 and a socket 36 for connection with the distal end of the shaft 10. The tamper head 14 may be a molded steel plate, a rubber coated steel plate or a steel plate with a rubber cover for example. Alternatively, the tamper head 14 may be comprise a mobile load, of sand or pebbles for example, selected for absorbing shocks upon impact of the flat lower surface 37 of the tamper head with the ground.

In an embodiment as shown for example in FIGS. 1, 2, 6 and 7, the handle 12 is a generally U-shaped element comprising a top member 20, grip members 22 and 24 extending from each end of the top member 20 generally perpendicular to the top member 20, and a socket 26 centered between the grip members 22 and 24 for balanced connection of the handle 12 with the shaft 10 as described hereinbelow.

The cross section of the handle 12 may be oval, circular or non-round, such as square or rectangular for example.

Figure 2A:
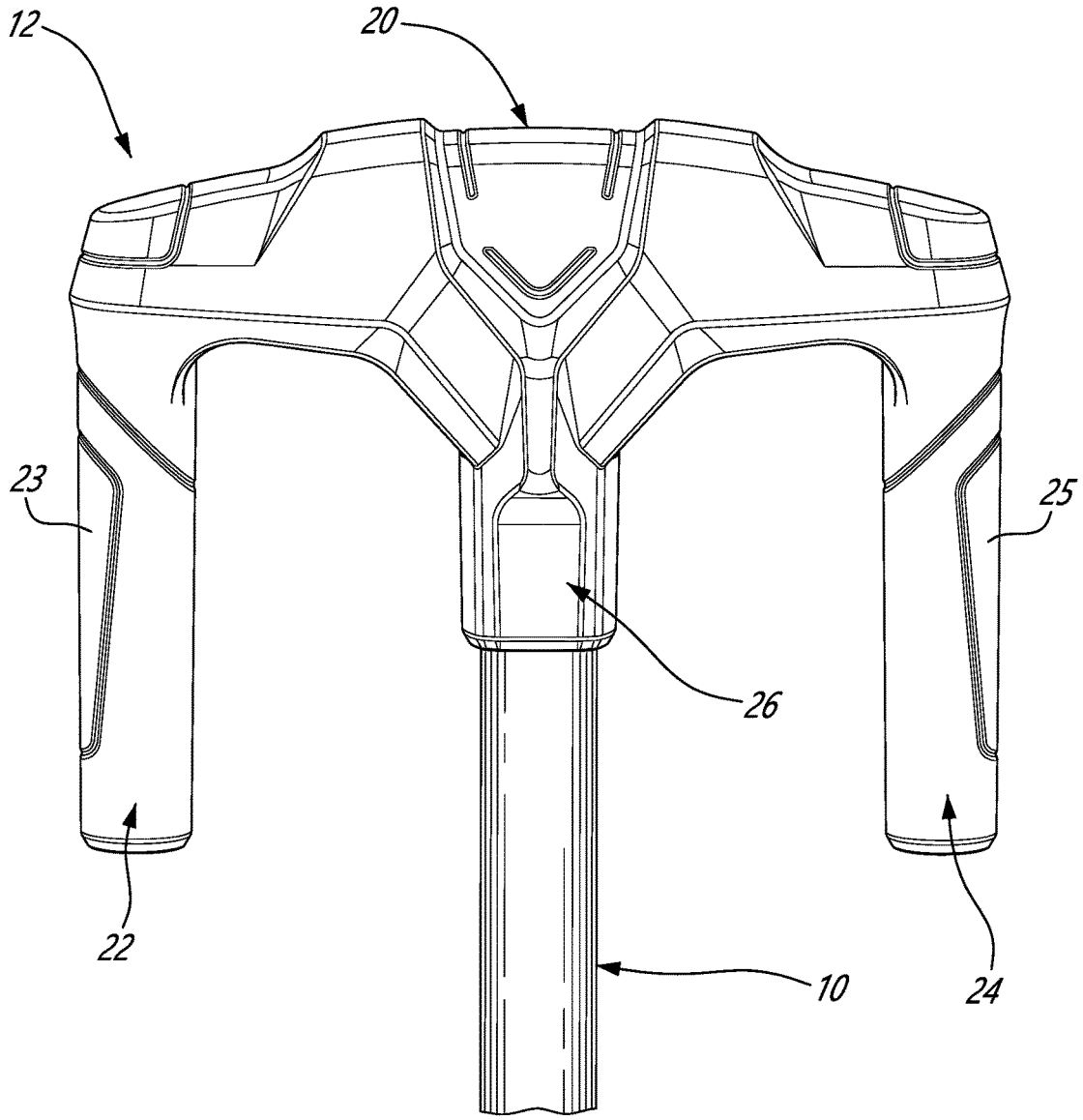
FIG. 2A is a front view of a handle of a tamper according to an embodiment of an aspect of the disclosure.
Figure 2B:
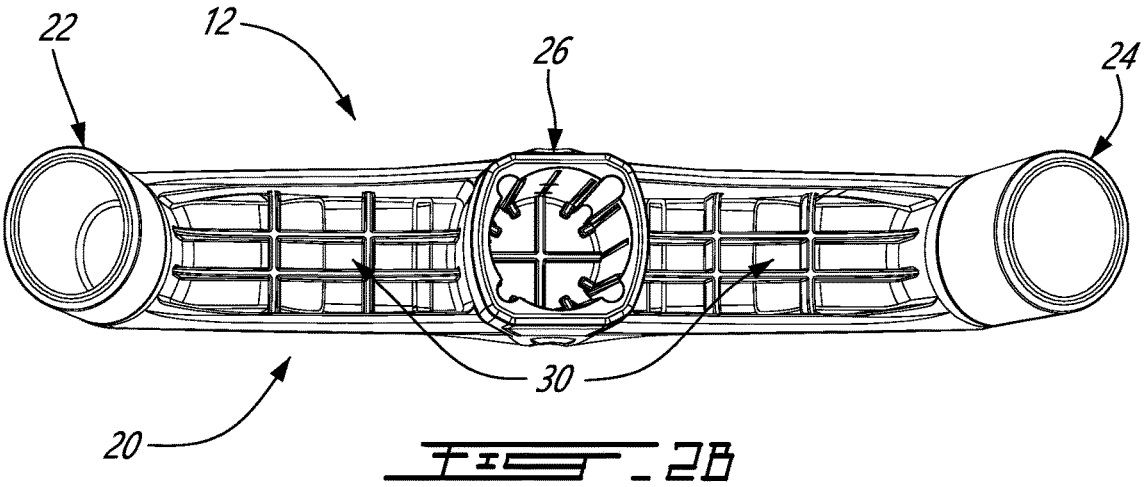
FIG. 2B shows details of the handle of FIG. 2A according to an embodiment of an aspect of the disclosure.

The handle 12 is made in a material selected for lightness and structural strength and stiffness, such as in nylon fiberglass, fiber-loaded polypropylenes, thermoplastic polymers such as acrylonitrile butadiene styrene (ABS) for instance, steel or aluminum, polycarbonate (PC), for example. FIG. 2B illustrates a hollow injection molded handle 12 with reinforcing ribs 30 selectively positioned for structural strength and stiffness.

As shown in 23 and 25 for example in FIGS. 2A, 6, 7A, 7B, the surface of the grip members 22 and 24 may be selectively texturized at the positions of the hands of the user to provide anti-skid surfaces for an optimized grip by the user. The texturization shape, density and distribution may be selected to achieve anti-skid properties targeted to prevent friction while avoiding skin irritation or injuries over time. In case of a molded handle, the texturization may be achieved during moulding or by over molding.

Figure 5:
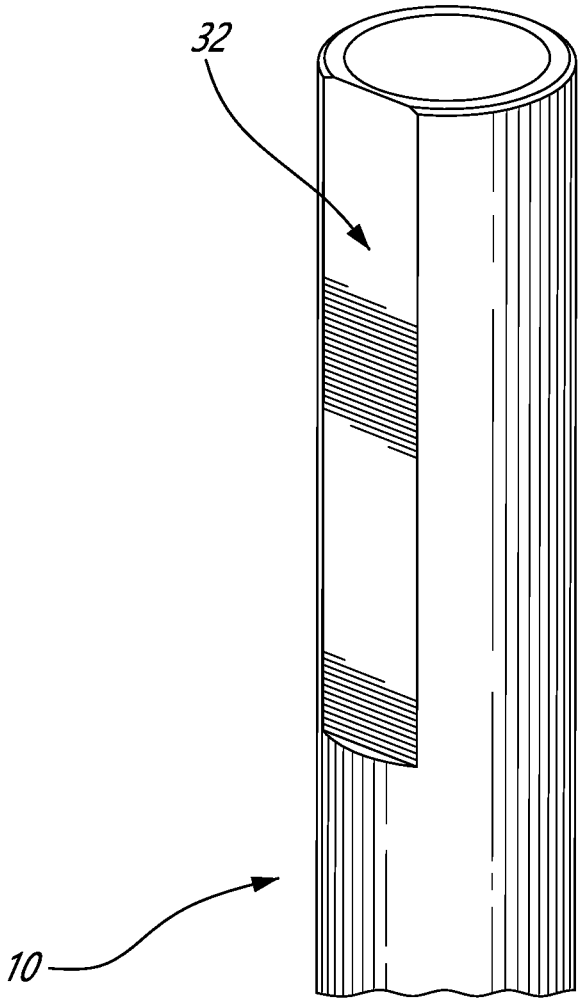
FIG. 5 shows details of a shaft of a tamper according to an embodiment of an aspect of the disclosure.
Figure 6:
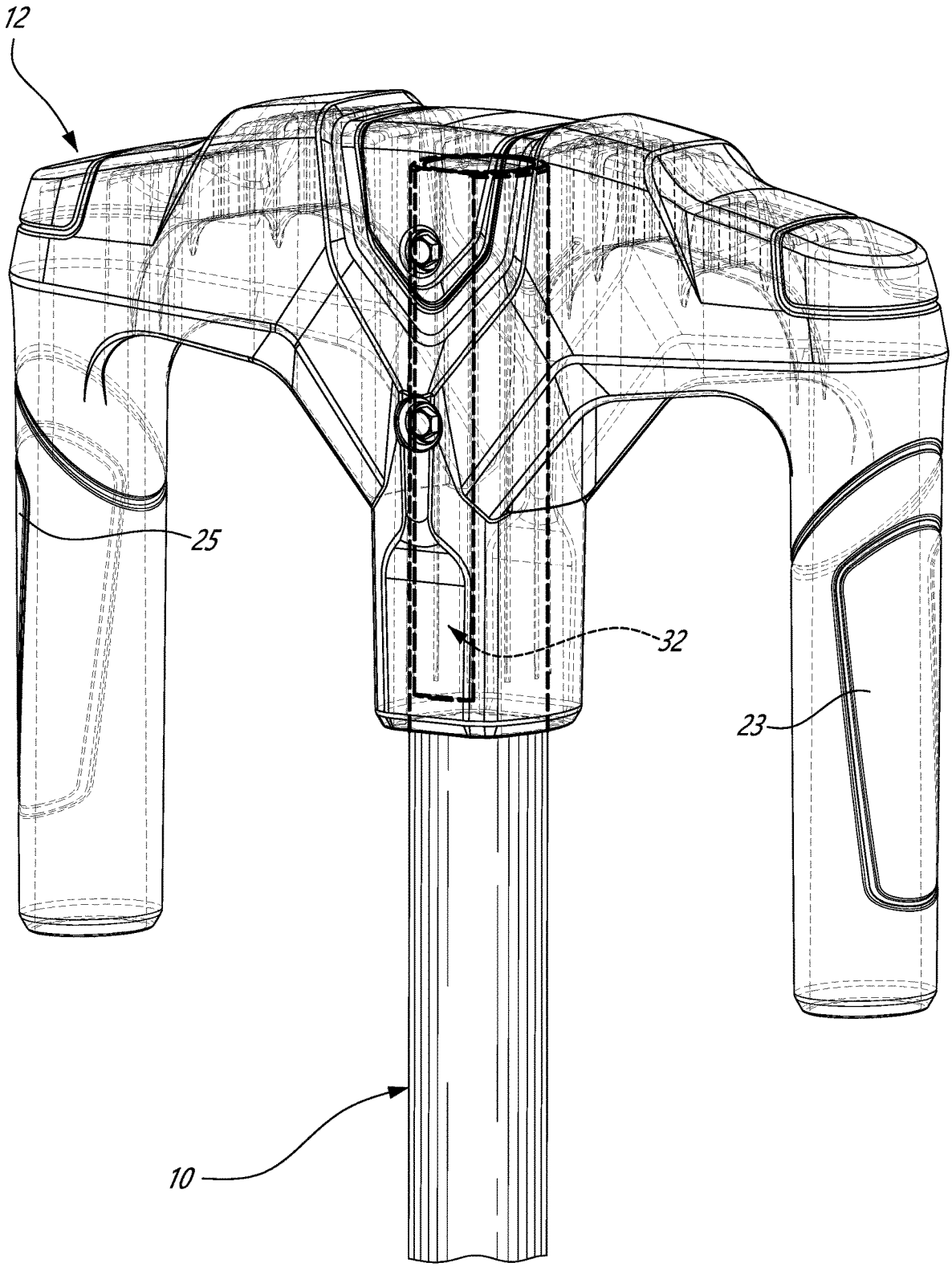
FIG. 6 shows details of connection of the handle and the shaft of a tamper according to an embodiment of an aspect of the disclosure.

The proximal end of the shaft 10 may be connected to handle 12 by press fit within the socket 26 or by using a rivet or a connection collar, (not shown), for example. In case of a wood head and of a wood shaft, wood wedges (not shown) may be used for connection within the socket 26. A screw (not shown) may be used to prevent relative rotation of the shaft 10 within the socket 26. Alternatively, the handle 12 and the shaft 10 may be connected by gluing using an epoxy for example. In the case of a round cross-section, the shaft may comprise a flat surface 32 at the proximal end thereof to prevent rotation on the handle 12 in the socket 26, as illustrated in FIGS. 5 and 6 (in transparency) for example. Alternatively, a non-round shaft, for example an oval or a square shaft, may be selected. The socket 26 of the shaft may be crimped to an aluminum or a steel handle. Aluminum or steel handle and shaft may also be welded together for example.

The tamper head 12 may be connected at the distal end of the shaft 10 within the socket 36, in any of the ways described hereinabove in relation to connection between the handle and the shaft, for a balanced connection of the tamper head 12 with the distal end of the shaft 10 of the handle 12 in relation to the connection of the handle 12 with the shaft 10 as described hereinabove.

Once thus connected, the grip members 22 and 24 at the proximal end of the shaft and generally parallel to the shaft 10 symmetrically on each side of the shaft 10 the tamping surface 37 at the distal end of the shaft and the grip members 22 and 24 extending generally parallel to the shaft 10 symmetrically on each side of the shaft 10 are operated by the user for efficient use if the tamper tool as describe hereinbelow.

A method for making a tamper according to an embodiment of an aspect of the present disclosure comprises connecting the handle 12 at the proximal end of the shaft 10 and the tamper head 14 at the distal end of the shaft 10.

Figure 3:
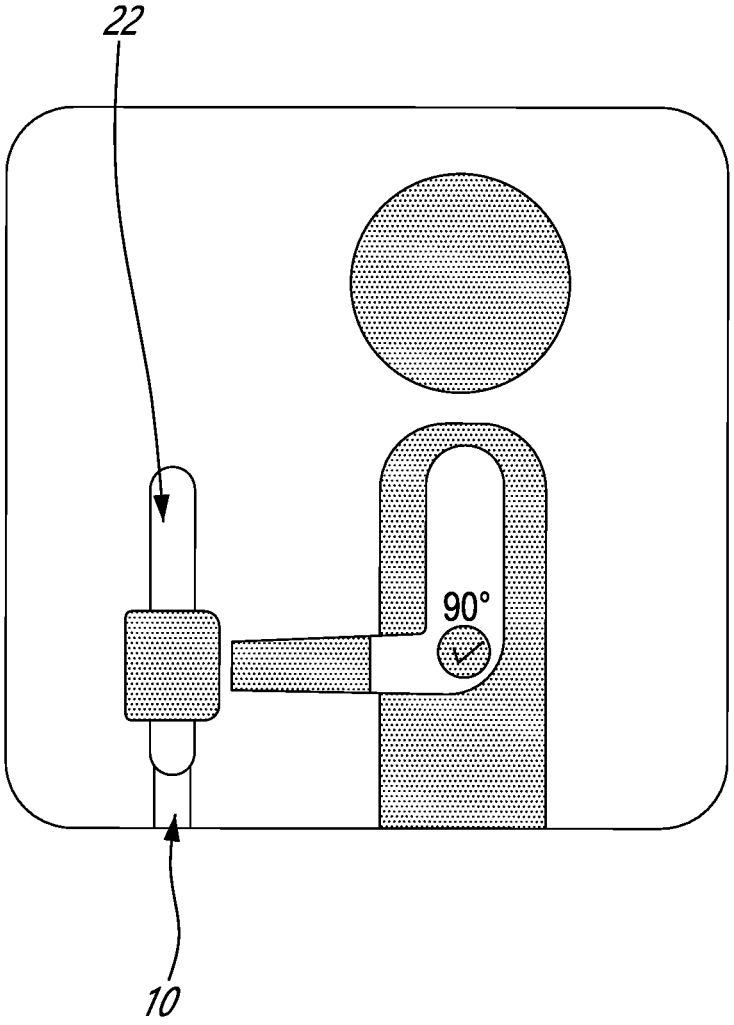
FIG. 3 is a partial side schematical view of a user of a tamper according to an embodiment of an aspect of the disclosure.
Figure 4:
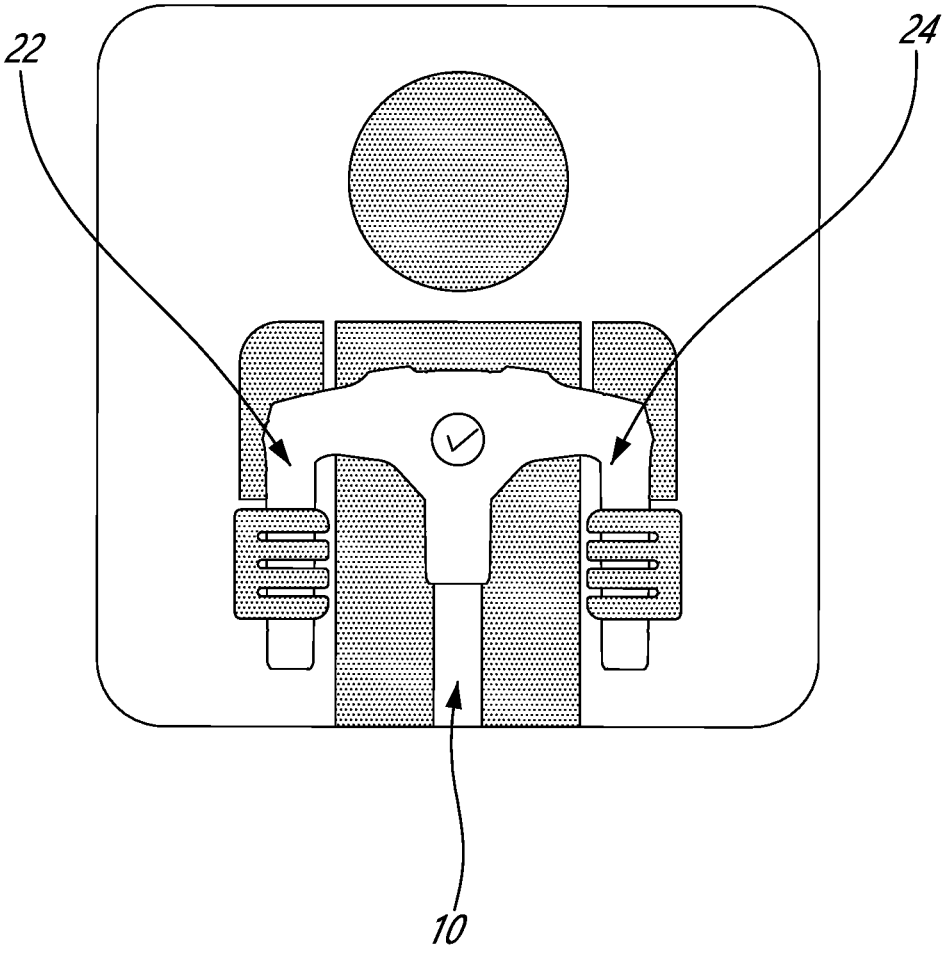
FIG. 4 is front schematical view of the user of the tamper of FIG. 3.

As exemplified in FIGS. 3 and 4, when using the tamper, the user holds the tamper using both hands, each one on a respective grip member 22, 24, and generally parallel to the shaft 10 at each end of the top member 20; the user's body is symmetrically positioned on a side of the tool (see FIG. 4) with a straight back, elbows at optimized distance and angle relative to the body, his arms and forearms at generally 90° as shown in FIG. 3. The user thus stands in a posture allowing maneuvering the handle as a handlebar hence controlling the tool using his strength efficiently in raising and dropping the tamper head on the ground while controlling horizontality of the flat lower surface 37 of the tamper head upon impacting the ground surface to efficiently compacting soils; the posture allows the user to direct and control the tamper head to reach corners or smaller ground spaces as needed.

In an embodiment of an aspect of the present disclosure, the handle 12 further comprise legs 50, 52 as illustrated in FIG. 7 or comprising a second pair of grip members (not shown) generally perpendicular to the shaft 10, extending from the top surface 20, in addition to the grip members 22, 24, thus providing additional handlebar positions for symmetric positioning of the user's hands.

The user is thus centered above the ground surface he plans to stamp, with his legs spreading to just beyond shoulder width so as to place his feet out of harm's way, his head centered between his feet, his hands having a firm grasp of the grip members on each side of the shaft, both hands level on a plane generally parallel to a ground surface to be tampered, enabled to raise and drop the tamper on the ground repeatedly, and adjust his body and precisely control the tamper to pack the ground surface and maintain the tamper head level in absence digging of edges and corners of the target surface and undoing of the packing.

As people in the art will appreciate, the present disclosure describes a selection of members, materials and of a combination and configuration thereof providing a controlled weight balance of the tamper resulting in an effective and controlled compacting action, while optimising ergonomic handling and use of the tamper in applications that are typically demanding and rough on the users' body.

The selected materials result in an optimized weight distribution from the handle to the working head of the tamper, enhanced maneuverability by the user for optimized impacting efficiency. Moreover, handling and ergonomics of the tamper are optimised since the members and configuration of the tool allows the user to hold the tamper with each hand symmetrically positioned on each side of the shaft, with his upper torso in a balanced position, his body in a symmetric, balanced positioning relative to the tamper allowing controlling the horizontality of the flat lower surface of the head impacting the ground for optimized impacting efficiency; both ergonomics and compaction efficiency are thus optimized.

The handle as described in the present disclosure in relation to a tamper tool may be used for an icebreaker tool, or other impact tools for example.

The scope of the claims should not be limited by the embodiments set forth in the examples, but should be given the broadest interpretation consistent with the description as a whole.

The invention claimed is:

1. A tool comprising a shaft, a handle at a proximal end of the shaft, and a working head at a distal end of the shaft, wherein the handle comprises at least a first and a second grip members, said first and second grip members extending generally parallel to the shaft on each side of the shaft and configured such that each one of the first and the second grip members may be grasped by a user with a respective hand of the user, thereby centering the user above a ground surface to be worked with the tool, with the user's legs spreading about shoulder width, the user's head centered between the user's feet, both the user's hands level on a line generally perpendicular to the shaft, and allowing the user to precisely control the working head.

2. The tool of claim 1, wherein a cross section of the handle is one of: oval, circular and rectangular.

3. The tool of claim 1, wherein the handle is hollow.

4. The tool of claim 1, wherein at least a surface of the grip members is selectively texturized.

5. The tool of claim 1, wherein the handle further comprises a socket for connection with the proximal end of the shaft.

6. The tool of claim 1, wherein the handle further comprises a socket for connection with the shaft, by one of: press fit, using a rivet, using a connection collar, using wedges, using screws, and gluing.

7. The tool of claim 1, wherein the handle is a generally U-shaped element comprising a top member, the first and second grip members extending generally perpendicularly from the top member at each end of the top member.

8. The tool of claim 1, wherein the handle is a generally U-shaped element comprising a top member, the first and second grip members extending generally perpendicularly from the top member at each end of the top member, and a socket centered between the first and second grip members opposite the top member for connection with the proximal end of the shaft.

9. The tool of claim 1, wherein the working head comprises a working surface and a socket for connection with the distal end of the shaft.

10. The tool of claim 1, wherein the working head comprises a socket for connection with the distal end of the shaft, by one of: press fit, using a rivet, using a connection collar, using wedges, using screws, and gluing.

11. The tool of claim 1, wherein the handle is made in one of: nylon fiberglass, fiber-loaded polypropylenes, thermoplastic polymers, steel, aluminum, and polycarbonate.

12. The tool of claim 1, wherein the working head comprises at least one of: sand and pebbles.

13. The tool of claim 1, wherein the working head is in one of: molded steel, rubber coated steel, steel with a rubber cover.

14. An impact tool comprising a shaft, a handle at a proximal end of the shaft, and a working head at a distal end of the shaft, wherein the handle comprises grip members extending generally parallel to the shaft on each side of the shaft; and the working head comprises an impacting surface, said grip members being configured such that each one of the first and the second grip members may be grasped by a user with a respective hand of the user so that the user is centered above a ground surface to be impacted with the impact tool, with the user's legs spreading to about shoulder width, the user's head centered between the user's feet, both hands level on a line generally perpendicular to the shaft.

15. The impact tool of claim 14, wherein the handle is made in one of: nylon fiberglass, fiber-loaded polypropylenes, thermoplastic polymers, steel, aluminum, polycarbonate, and injection molding; and the working head is one of: steel, rubber coated steel, steel plate with a rubber cover.

16. A method for making a tool comprising a shaft, a handle, and a working head, comprising providing the handle with at least a first and a second grip members, connecting the handle with the proximal end of the shaft and the working head at a distal end of the shaft, the first and the second grip members extend generally parallel to the shaft on each side of the shaft; whereby the first and the second grip members are symmetrically positioned on each side of the shaft and available for a user using both hands, one hand on a respective one of the first and the second grip members, centering the user above a ground surface to be worked with the tool, with the user's legs spreading about shoulder width, the user's head centered between the user's feet, both the user's hands level on a line generally perpendicular to the shaft.

17. The method of claim 16, further comprising providing a socket on the handle for connection with the distal end of the shaft, by one of: press fit, using a rivet, using a connection collar, using wedges, using screws, and gluing.

18. The method of claim 16, further comprising providing a socket on the working head for connection with the proximal end of the shaft, by one of: press fit, using a rivet, using a connection collar, using wedges, using screws, and gluing.

* * * * *